US008561279B2

(12) United States Patent
Kohno et al.

(10) Patent No.: US 8,561,279 B2
(45) Date of Patent: Oct. 22, 2013

(54) SPRING PRODUCT MANUFACTURING LINE

(75) Inventors: Kazuhiro Kohno, Ichihara (JP); Yasuhiro Adachi, Ichihara (JP); Hiroki Watanabe, Ichihara (JP); Norio Takahashi, Ichihara (JP)

(73) Assignee: Mitsubishi Steel Mfg. Co., Ltd., Tokyo (JP)

( * ) Notice: Subject to any disclaimer, the term of this patent is extended or adjusted under 35 U.S.C. 154(b) by 273 days.

(21) Appl. No.: 12/678,604

(22) PCT Filed: Sep. 18, 2008

(86) PCT No.: PCT/JP2008/066866

§ 371 (c)(1),
(2), (4) Date: Mar. 17, 2010

(87) PCT Pub. No.: WO2009/038133

PCT Pub. Date: Mar. 26, 2009

(65) Prior Publication Data

US 2010/0212134 A1 Aug. 26, 2010

(30) Foreign Application Priority Data

Sep. 19, 2007 (JP) ..... 2007 242827

(51) Int. Cl.
*B21D 39/03* (2006.01)

(52) U.S. Cl.
USPC ..... 29/430; 29/407; 483/28; 219/79; 219/86.8; 72/7.1; 72/442

(58) Field of Classification Search
USPC ..... 72/135, 137, 140, 145, 420, 444, 446, 72/1, 237, 226; 29/896.9, 896.91, 430, 29/431, 822, 823, 824, 563, 33 P, 407; 483/28, 29; 285/84; 280/47.34; 219/79, 219/86.8; 148/12
See application file for complete search history.

(56) References Cited

U.S. PATENT DOCUMENTS 4,369,563 A * 1/1983 Williamson ..... 483/7
4,526,628 A * 7/1985 Ohno et al. ..... 148/520

(Continued)

FOREIGN PATENT DOCUMENTS

JP 10-044157 2/1998
JP 10-175033 * 6/1998
JP 10-175034 6/1998

OTHER PUBLICATIONS

International Search Report in corresponding PCT/JP08/66866 dated Nov. 4, 2008.

(Continued)

*Primary Examiner* — Dana Ross
*Assistant Examiner* — Homer Boyer
(74) *Attorney, Agent, or Firm* — Marshall, Gerstein & Borun LLP

(57) ABSTRACT

The invention provides a spring product manufacturing line comprising: a manufacturing area 2 at which a formation device 50 attached to a base mount 52 plastically processes a spring material into a spring product; a formation device switching area 3 at which one formation device 50 is removed from the mount 52 and switched with another forming device 50; and a formation device transport line 4 that conveys a formation device 50 attached to a base mount 52 at the device switching area 3 to a manufacturing area 2; wherein the formation device 50 is provided with a plurality of formation units 54 that perform a bending process on the spring material by fluid pressure; the base mount 52 is provided with a pressure fluid line 62 that supplies pressure fluid to the formation units 54 provided at the formation device 50, and that is removably connected to each of the formation units 54; and the attachment or removal of the pressure fluid line 62 with respect to the formation device 50 is performed at the device switching area 3.

4 Claims, 6 Drawing Sheets

(56) References Cited

U.S. PATENT DOCUMENTS

| | | | | |
|---|---|---|---|---|
| 5,040,403 | A * | 8/1991 | Henderson et al. | 72/446 |
| 5,582,062 | A * | 12/1996 | Sommer | 72/448 |
| 5,913,761 | A * | 6/1999 | Kamada et al. | 483/29 |
| 5,947,880 | A * | 9/1999 | Stagnitto et al. | 483/58 |
| 6,394,941 | B2 * | 5/2002 | Kawamoto et al. | 483/29 |
| 2008/0104815 | A1 * | 5/2008 | Kussmaul | 29/407.01 |

OTHER PUBLICATIONS

Written Opinion in corresponding PCT/2008/66866 dated Oct. 24, 2008. (Japanese only).

* cited by examiner

SPRING PRODUCT MANUFACTURING LINE

BACKGROUND OF THE INVENTION

1. Field of the Invention

The present invention relates to a spring manufacturing line, and in particular, a spring manufacturing line in which a formation device that manufactures a spring product may be easily switched.

2. Description of Related Art

A stabilizer is connected to left and right suspension devices of a vehicle and thereby prevents rolling of the vehicle; however, in order to avoid interference with parts disposed at a lower surface of the vehicle, such as a differential gear, a propeller shaft or the like, the stabilizer is manufactured by bending a rod-shaped spring material into a complex 3-dimensional shape.

A formation device is used to bend the spring material into a 3-dimensional shape. The formation device is provided with a plurality of formation units that perform a hydraulic bending process on the spring material, and a control unit that controls the formation units. The control unit operates each of the formation units in a predetermined order, and as a result the spring material is bent into a predetermined shape to become a stabilizer.

However, since the position of parts such as a differential gear, a propeller shaft or the like, differs depending on the type of vehicle, it is necessary to change the shape of a stabilizer according to each type.

As a result, in a stabilizer manufacturing line, it has been necessary to prepare a plurality of formation units with different arrangements and configurations, and when a stabilizer with a different shape is to be manufactured, to switch formation units according to the shape of the stabilizer to be manufactured.

However, when a formation unit is to be switched, it is necessary to detach a hydraulic line or air pressure line or the like that drives each formation unit, from a stand (a base mount) to which the formation device is attached at the time of manufacturing a stabilizer, and subsequently, after releasing a lock mechanism that secures the formation device to the stand, to lift the formation device by a crane and move it to a reserve stand.

As a result, the switching of formation devices is a laborious operation. Particularly, when a plurality of types of stabilizers are to be manufactured by a single line, since it is necessary to switch formation devices within short intervals, such as two hours, the necessarily laborious nature of the switching becomes a serious problem.

As a manufacturing device that addresses the above problem, a stabilizer formation device has been proposed in which a platform shaped main body is provided with plural attachment mounts, the respective positions of the attachment mounts being adjustable, and formation units are respectively secured to the attachment mounts, and by adjusting the positions of the attachment mounts, the positions of the formation units may be adjusted (see Japanese Patent Application Laid-Open (JP-A) No. 10-175034).

SUMMARY OF THE INVENTION

However, even with the above stabilizer formation device, since it is still necessary to detach formation units from the attachment mounts when switching formation units, and move them to a reserve stand by a crane or the like, the above device does not fully achieve the aim of facilitating switching of the formation units.

The present invention has been achieved in consideration of the above problem, and an aim thereof is to provide a stabilizer manufacturing line in which formation devices themselves may be easily switched.

The invention of claim 1 relates to a spring product manufacturing line including: a manufacturing area at which a formation device attached to a base mount plastically processes a spring material into a spring product; a formation device switching area at which one formation device is removed from the mount and switched with another forming device; and a formation device transport line that conveys a formation device attached to a base mount at the device switching area to a manufacturing area; in which the formation device is provided with a plurality of formation units that perform a bending process on the spring material by fluid pressure; the base mount is provided with a pressure fluid line that supplies pressure fluid to the respective formation units provided at the formation device, and that is removably connected to respective formation units; and the attachment or removal of the pressure fluid line with respect to a formation device is performed at the device switching area.

In the spring product manufacturing line according to claim 1, in the manufacturing area, a formation device which has been used until now is moved together with its base mount by a device transport line to a device switching area, and a new readied formation device is moved from the device switching area to the manufacturing area, thus enabling switching of formation devices at a manufacturing area.

Additionally, in the manufacturing area, there is no need to remove a formation device from a base mount, and therefore the attachment and removal of a pressure fluid line with respect to a formation device is not performed. The removal and attachment of a formation device with respect to a base mount, as well as the removal and attachment of a pressure fluid line, is performed at the device switching area.

The invention according to claim 2 relates to a spring product manufacturing line in which the formation device transport line includes a car on which may be placed a plurality of formation devices attached to base mounts, and a running path on which the car runs.

In the spring product manufacturing line of claim 2, when a formation device is to be replaced at a manufacturing area, a new formation device, to which a pressure fluid line has been connected, is placed on a mount at the device switching area, and then placed on the car. Subsequently, the car runs along the running path and moves to the manufacturing area. When the car arrives at the manufacturing area, the formation device that has been used until now is placed thereon together with its base mount. Then, the new formation device on the car is moved together with its base mount to the manufacturing area.

The invention of claim 3 relates to a spring product manufacturing line according to claim 1 or claim 2 in which the spring product manufactured at the manufacturing area is a vehicle stabilizer.

EFFECTS OF THE INVENTION

As explained above, in the invention of claim 1, formation devices are moved together with their base mounts by the device transport line between the manufacturing area and the device switching area, and formation devices are switched at the manufacturing area. Further, operations that require a certain amount of time, such as attaching and removing a pressure fluid line, are not performed at the manufacturing area. As a result, formation devices may be switched at the manufacturing area within a short space of time.

In the invention of claim 2, it is possible to complete the switching of a formation device at the manufacturing area simply by one round trip of the car between the manufacturing area and the device switching area. As a result, a formation device may be switched in even less time, compared to the spring product manufacturing line of claim 1.

In the invention of claim 3, since the switching of formation units at the manufacturing area can be performed in a short space of time as described above, the invention may be used advantageously when manufacturing various types of stabilizers at a single line.

BEST MODE FOR IMPLEMENTING THE INVENTION

First Embodiment

A stabilizer manufacturing line, as an example of the spring product manufacturing line according to the present invention, is described below.

Figure 1:
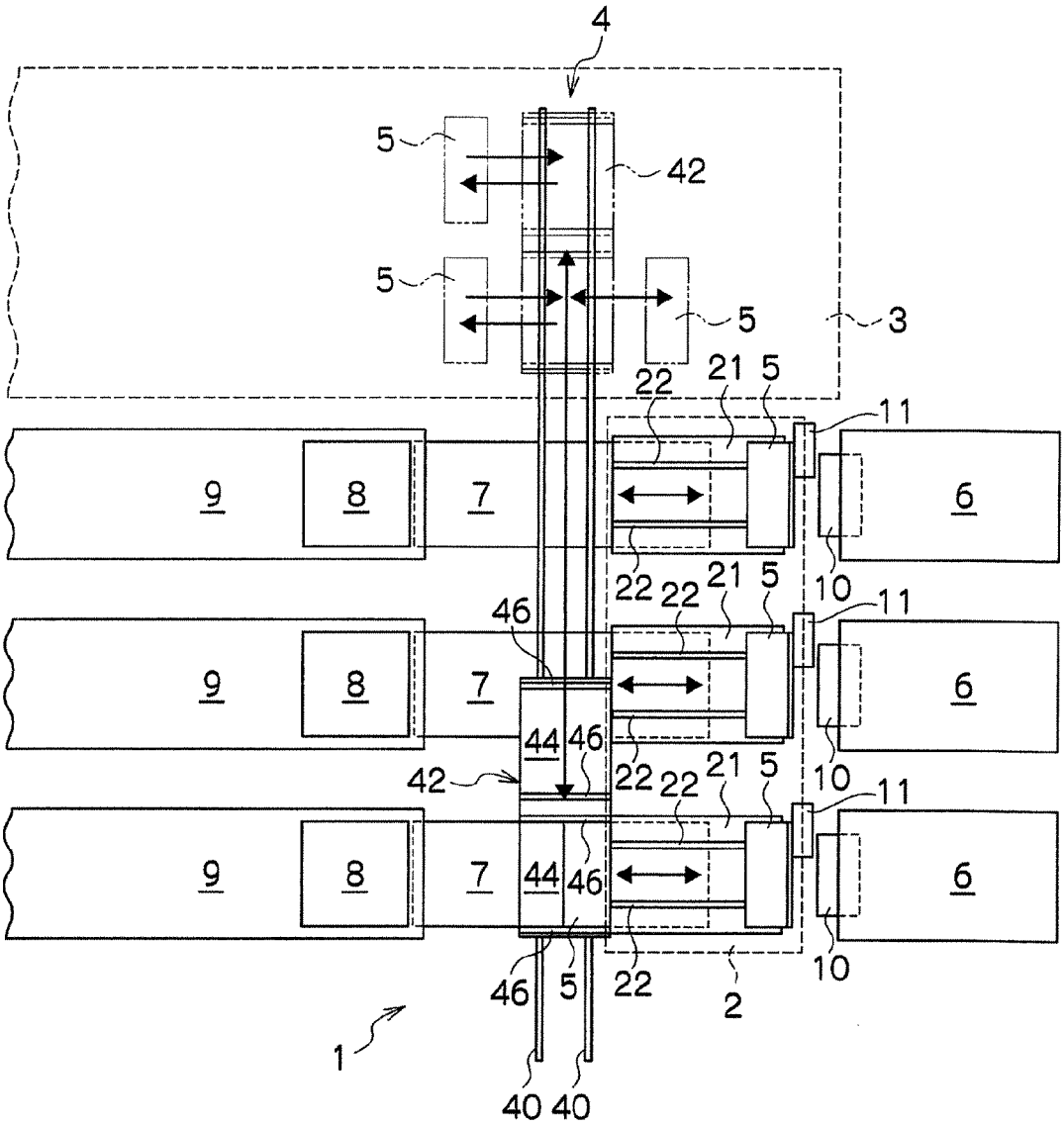
FIG. 1 is a plan view showing an overall configuration of the stabilizer manufacturing line according to a first embodiment.
Figure 2:
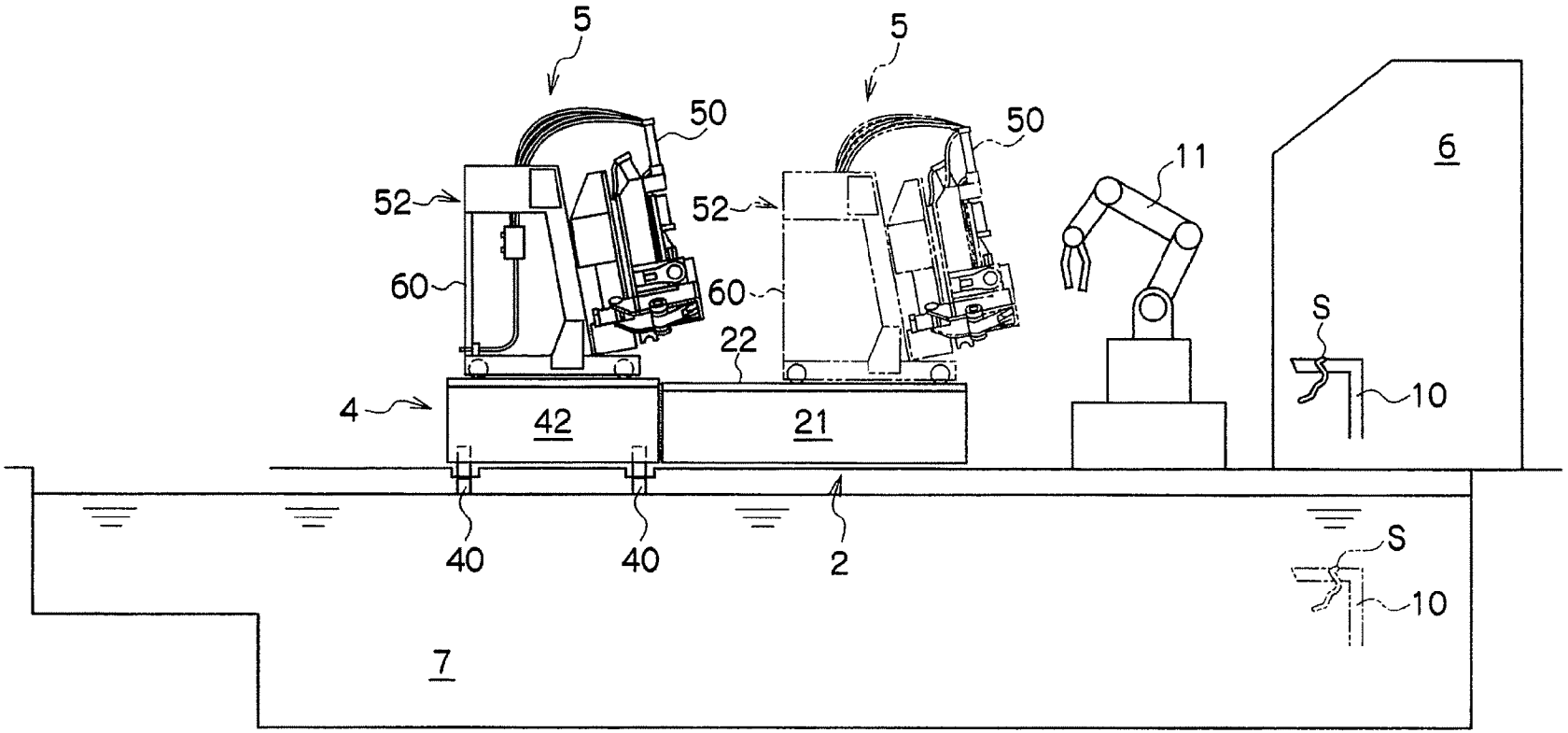
FIG. 2 is a side view showing a configuration of a manufacturing area provided at the stabilizer manufacturing line of FIG. 1.

As shown in FIGS. 1 and 2, stabilizer manufacturing line 1 according to the first embodiment is provided with a stabilizer manufacturing device 5, a manufacturing area 2, at which is manufactured stabilizer S, which is an example of the spring product of the present invention, a device switching area 3, at which a formation device 50 provided to stabilizer manufacturing device 5 is detached from a base mount 52 and switched with a new formation device 50, and a formation device transport line 4 that transports stabilizer manufacturing device 5 between manufacturing area 2 and device switching area 3.

As shown in FIGS. 1 and 2, in stabilizer manufacturing line 1, a heating oven 6, that heats a spring steel wire, which is a rod-shaped material with both ends thereof press-forged, is provided adjacent to manufacturing area 2. A quenching tank 7, in which stabilizer S, which has been manufactured by bending the spring steel wire heated at heating oven 6 at stabilizer manufacturing device 5, is oil-quenched, is provided below manufacturing area 2 and formation device transport line 4. Further, a cleaning device 8, which cleans stabilizer S which has been quenched in quenching tank 7, and a tempering furnace 9, which tempers stabilizer S which has been cleaned in cleaning device 8, are also provided in the vicinity of quenching tank 7. A transfer robot 11, which supplies the spring steel wire which has been heated at heating oven 6 to stabilizer manufacturing device 5, and which transfers stabilizer S which has been manufactured at stabilizer manufacturing device 5 to a quenching insertion device 10, is also provided between manufacturing area 2 and heating oven 6.

At manufacturing area 2, three mounts 21 to which stabilizer manufacturing devices 5 are attached are provided along formation device transport line 4. At upper surfaces of mounts 21 are provided rails 22 for moving stabilizer manufacturing devices 5, which are transported to manufacturing area 2 by formation device transport line 4, to predetermined positions, and securing devices (not shown) that secure stabilizer manufacturing devices 5 at the predetermined positions.

Figure 3:
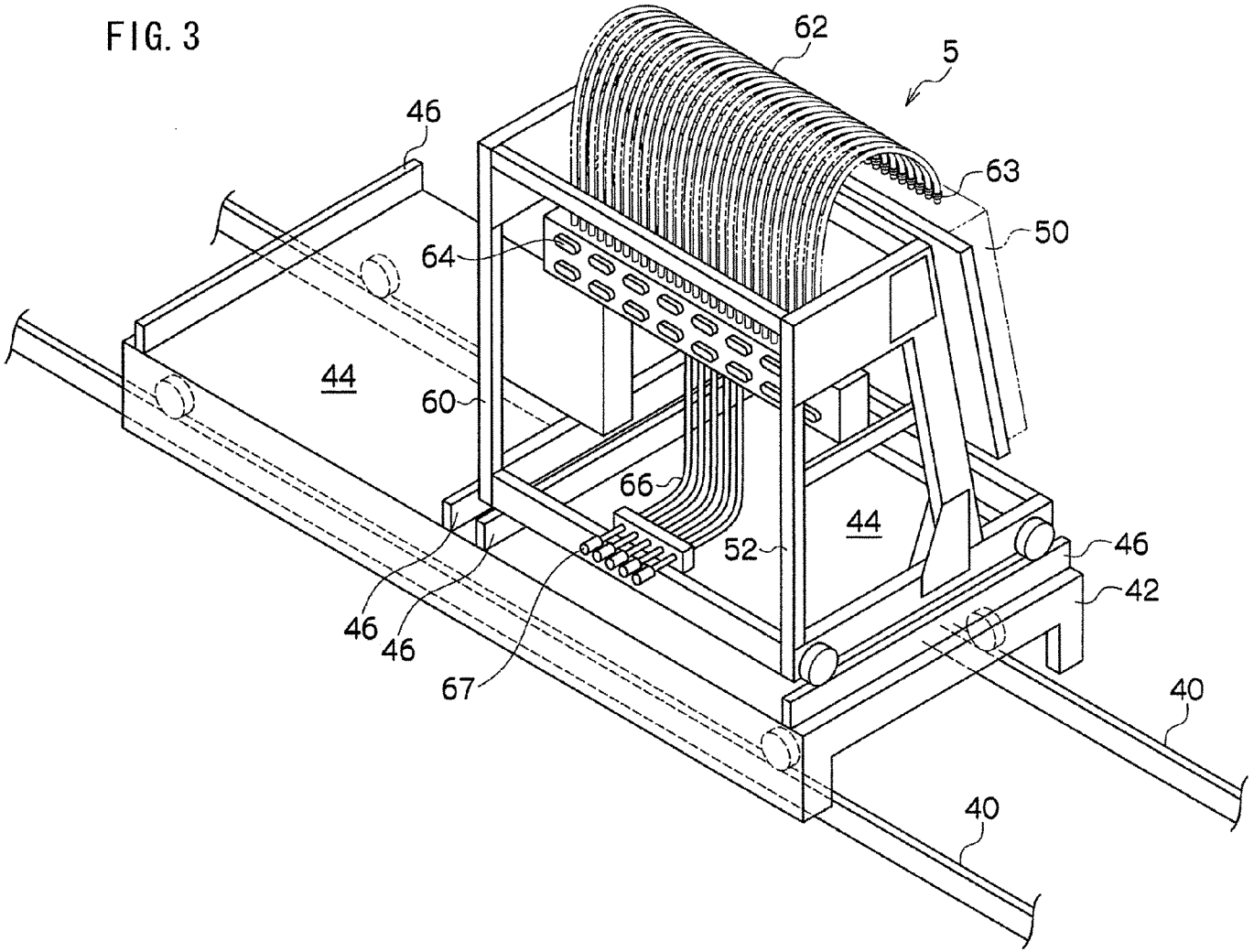
FIG. 3 is a perspective view showing a configuration of a car portion of a stabilizer manufacturing device provided at the stabilizer manufacturing line of FIG. 1.

As shown in FIGS. 1-4B, formation device transport line 4 is made up of a rail 40, and a car 42 that runs on rail 40. As shown in FIGS. 1 and 3, at the upper surface of car 42, manufacturing device mounting area 44, at which stabilizer manufacturing device 5 is mounted, is provided at two places. At manufacturing device mounting area 44 is provided a rail 46, which is perpendicular to rail 40, and on which runs stabilizer manufacturing device 5, and a securing device (not shown) that secures stabilizer manufacturing device 5 so that it does not move on rail 46 while car 42 is running.

Figure 4A:
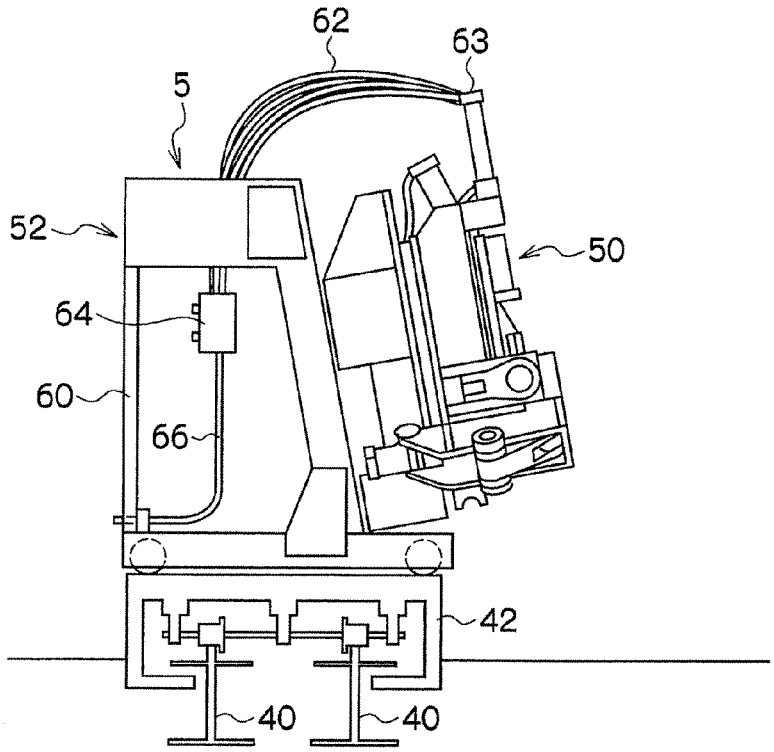
FIGS. 4A and 4B are an explanatory view showing a forming device when attached to, and when detached from, a base mount of the stabilizer manufacturing device.
Figure 4B:
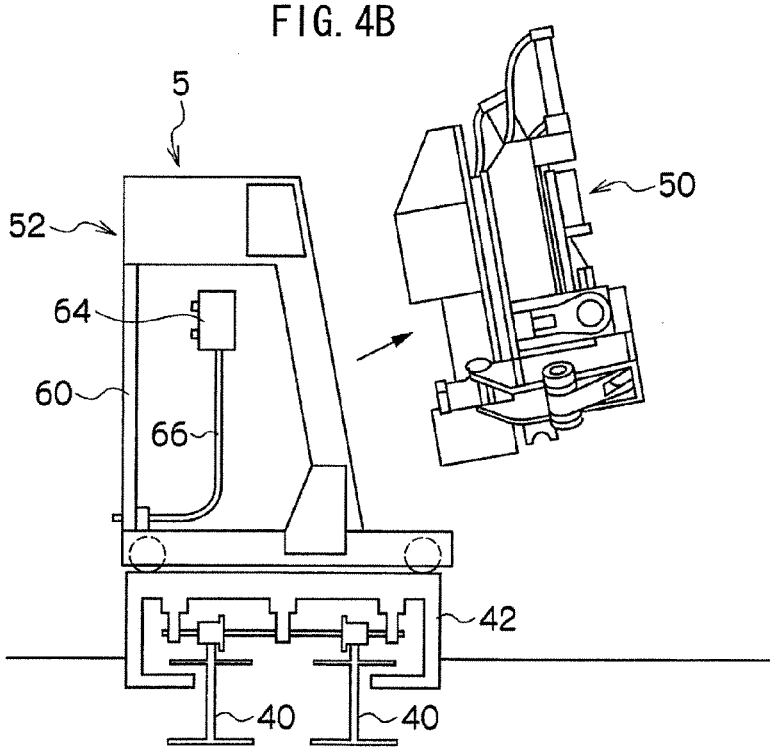

Stabilizer manufacturing device 5, as shown in FIGS. 2-4, includes formation device 50, which bends a spring steel wire into a predetermined shape to form stabilizer S, and a base mount 52 to which formation device 50 is removably attached. Further, FIG. 4A indicates a state in which formation device 50 is attached to base mount 52, and FIG. 4B indicates a state in which formation device 50 is removed from base mount 52.

Figure 5:
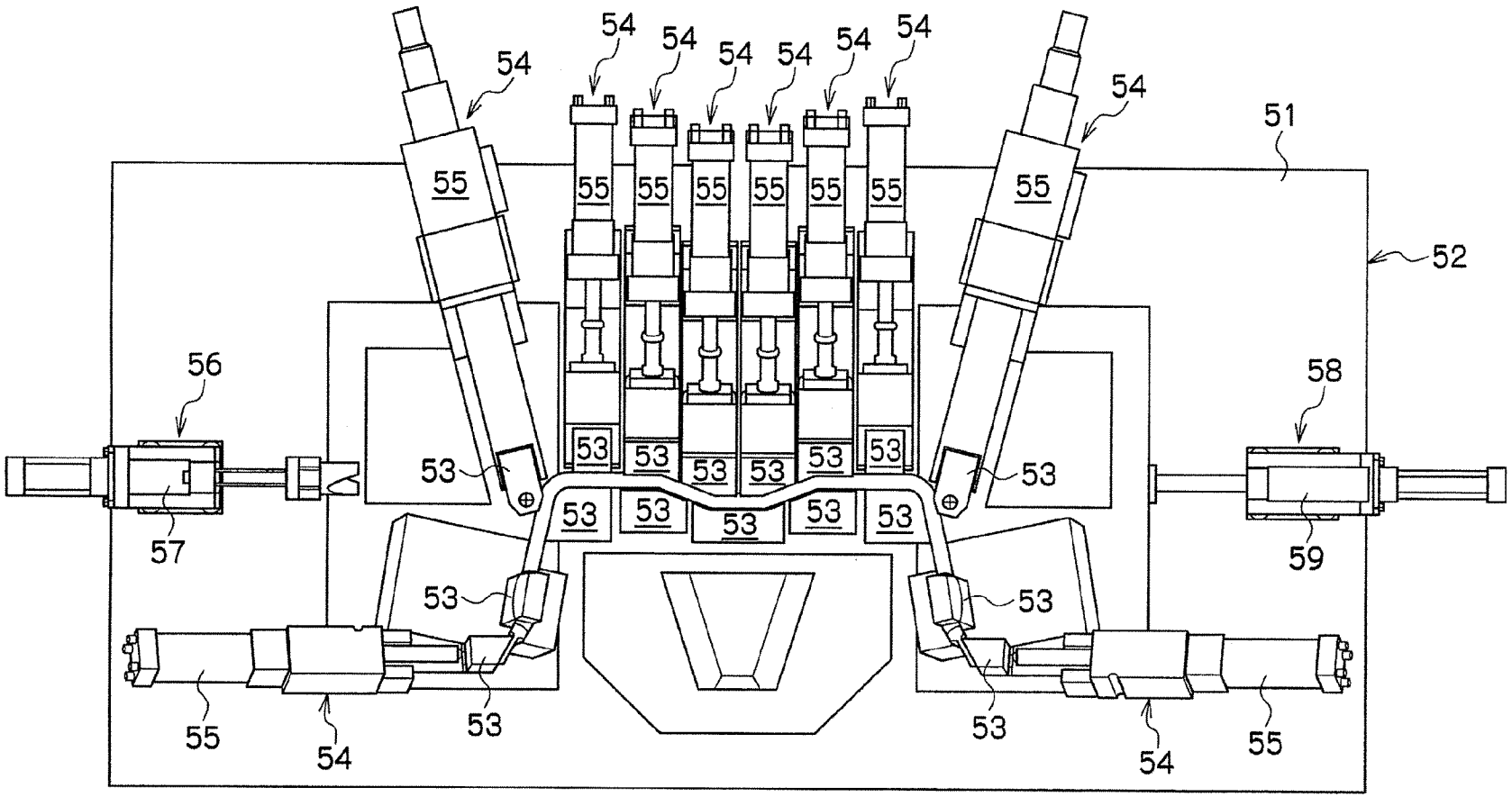
FIG. 5 is a plan view showing the configuration of the formation device provided at the stabilizer manufacturing line.

As shown in FIG. 5, formation device 50 includes a base plate 51, a formation unit 54, which bends a spring steel wire into a predetermined shape to form stabilizer S, on base plate 51, and positioning units 56 and 58, which position formation unit 54 on base plate 51.

Formation unit 54 includes a jig 53, and a hydraulic cylinder 55 which moves jig 53 in a predetermined direction to bend a spring steel wire. Further, positioning unit 56 is driven by a hydraulic cylinder 57, and positioning unit 58 is driven by a hydraulic cylinder 59.

As shown in FIGS. 2-5, base mount 52 includes a car portion 60 which runs on rail 46, hydraulic hoses 62, which are pressure fluid supply lines, and which supply hydraulic fluid to hydraulic cylinders 55, 57 and 59, at an upper end of car portion 60, a hydraulic control valve 64, which controls the opening and closing of hydraulic hoses 62 to operate formation units 54 in a predetermined order, and a hydraulic source pipe 66, which supplies hydraulic fluid to hydraulic cylinders 55, 57 and 59, via hydraulic control valve 64 and hydraulic hoses 62. Hydraulic hoses 62 are attached to hydraulic cylinders 55, 57 and 59 by a one-touch coupler 63. Further, at the end of hydraulic source pipe 66 is provided a source connection coupler 67 that connects to a hydraulic supply source (not shown) in manufacturing area 2.

An explanation of the operation of stabilizer manufacturing line 1 is given below.

In stabilizer manufacturing line 1, a spring steel wire, both ends of which have been previously press-forged into a predetermined shape, is heated at heating oven 6. After the spring steel wire is sufficiently heated at heating oven 6, the angles and the like of end portions thereof are configured by a positioning device (not shown), and it is passed to stabilizer manufacturing device 5 by transfer robot 11. At stabilizer manufacturing device 5, the spring steel wire is bent into a predetermined shape by formation unit 54 to become stabilizer S.

Stabilizer S manufactured in this manner is then conveyed instantly to quenching insertion device 10 by transfer robot 11, and quenched by insertion into quenching tank 7 by quenching insertion device 10. Stabilizer S quenched by quenching tank 7 is then cleaned by cleaning device 8 and tempered by tempering furnace 9.

When manufacturing a further stabilizer S having a different shape, it is necessary to switch stabilizer manufacturing device 5 with another device provided with a different formation device 50. A switching procedure of stabilizer manufacturing device 5 is explained below.

In parallel with the manufacture of stabilizer S at manufacturing area 2, a new formation device 50 is attached to base mount 52 at device switching area 3, and hydraulic hoses 62 are connected to hydraulic cylinders 55, 57 and 59 at new formation device 50, so that stabilizer manufacturing device 5 is made ready to use simply by connecting a hydraulic source pipe 66 to a hydraulic supply source, and an electricity supply line (not shown) to an electricity source at manufacturing area 2.

Figure 6A:
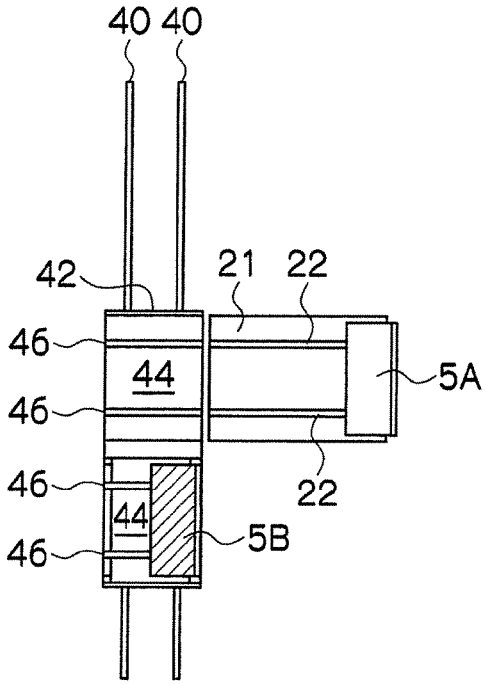
FIGS. 6A to 6D are an explanatory view showing the switching procedure of a stabilizer manufacturing device at the manufacturing area.

When a stabilizer manufacturing device 5A which has been used until now in manufacturing area 2, is to be switched, a fully readied stabilizer manufacturing device 5B at device switching area 3 is mounted to one of two manufacturing device mounting areas 44 of car 42, as shown in FIG. 6A. Subsequently, car 42 runs from device switching area 3 toward manufacturing area 2, and stops at mount 21, at which stabilizer manufacturing device 5A, which is to be switched, is attached, stopping at a position such that stabilizer manufacturing device 5A adjoins the empty one of manufacturing device mounting areas 44.

Figure 6B:
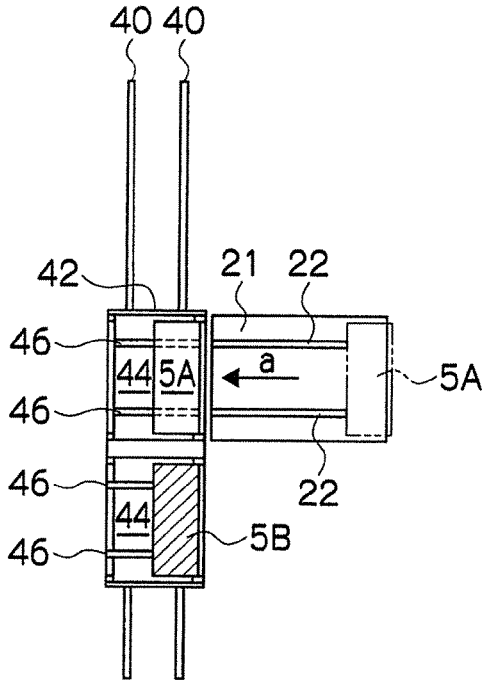

Next, as shown in FIG. 6B, stabilizer manufacturing device 5A runs on rail 22 on mount 21 in the direction of arrow a, and is placed on and secured at the empty one of manufacturing device mounting areas 44 on car 42.

Figure 6C:
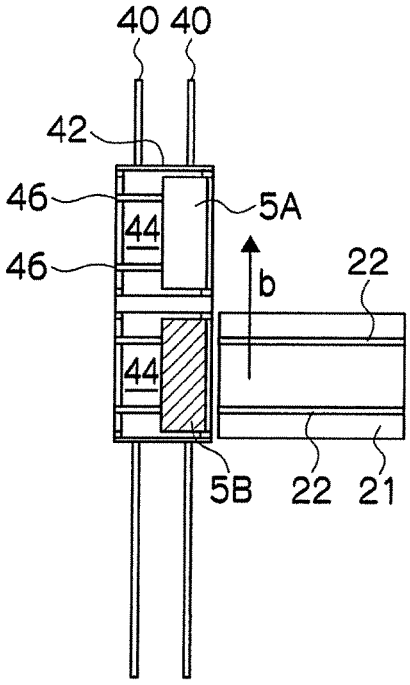
Figure 6D:
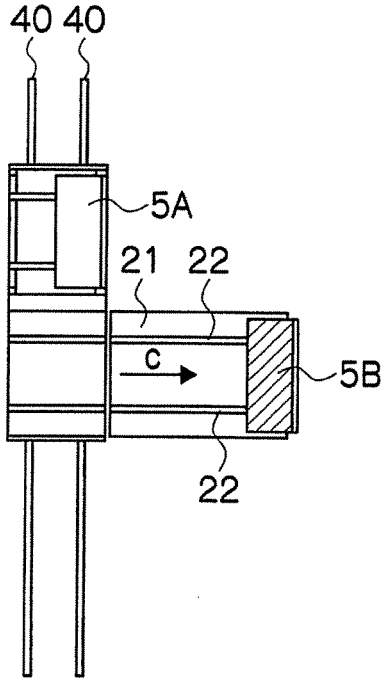

Once stabilizer manufacturing device 5A is secured at car 42, car 42 moves in the direction of arrow b, and stops at a location such that stabilizer manufacturing device 5B is adjacent to mount 21 of manufacturing area 2, as shown in FIG. 6C. Subsequently, as shown in FIG. 6D, stabilizer manufacturing device 5B is moved to mount 21, and secured at a predetermined position.

DESCRIPTION OF REFERENCE NUMERALS

1 Stabilizer manufacturing line
2 Manufacturing area
3 Device switching area
4 Device transport line
5 Stabilizer manufacturing device
5A Stabilizer manufacturing device
5B Stabilizer manufacturing device
6 Heating oven
7 Quenching tank
8 Cleaning device
9 Tempering furnace
10 Quenching insertion device
11 Transfer robot
21 Mount
22 Rail
40 Rail
42 Car
44 Manufacturing device mounting area
46 Rail
50 Formation device
51 Base plate
52 Base mount
53 Jig
54 Formation unit
55 Hydraulic cylinder
56 Positioning unit
57 Hydraulic cylinder
58 Positioning unit
59 Hydraulic cylinder
60 Car portion
62 Hydraulic hoses
63 One-touch coupler
64 Hydraulic control valve
66 Hydraulic source pipe
67 Source connection coupler

The invention claimed is:

1. A spring product manufacturing line, comprising:

a manufacturing area at which a formation device attached to a base mount plastically processes a spring material into a spring product;

a formation device switching area at which one formation device is removed from the base mount and switched with another formation device; and a formation device transport line that conveys a formation device attached to a base mount between the device switching area and a manufacturing area; wherein the formation device is provided with a plurality of formation units that perform a bending process on the spring material by fluid pressure;

the base mount is provided with a pressure fluid line that supplies pressure fluid to respective formation units provided at the formation device, and that is removably connected to the respective formation units; and the attachment or removal of the pressure fluid line that is provided at the base mount to or from a formation device is performed at the device switching area.

2. The spring product manufacturing line of claim 1, wherein the formation device transport line comprises a car on which may be placed a plurality of formation devices attached to base mounts, and a running path on which the car runs.

3. The spring product manufacturing line of claim 1, wherein the spring product manufactured at the manufacturing area is a vehicle stabilizer.

4. The spring product manufacturing line of claim 1, further comprising:

a heat-treating device for quenching and tempering the spring product manufactured at the manufacturing area.

* * * * *